US005306334A

United States Patent [19]

Martyak et al.

[11] Patent Number: 5,306,334

[45] Date of Patent: Apr. 26, 1994

[54] ELECTROLESS NICKEL PLATING SOLUTION

[75] Inventors: Nicholas M. Martyak, Ballwin; Bruce F. Monzyk, Maryland Heights, both of Mo.

[73] Assignee: Monsanto Company, St. Louis, Mo.

[21] Appl. No.: 916,572

[22] Filed: Jul. 20, 1992

[51] Int. Cl.[5] ..... C23C 18/36

[52] U.S. Cl. ..... 106/1.22

[58] Field of Search ..... 106/1.22, 1.27

[56] References Cited

U.S. PATENT DOCUMENTS

| | | | |
|---|---|---|---|
| 3,686,020 | 8/1972 | Coll-Palagos | 106/1.22 |
| 3,971,861 | 7/1976 | de Waltoff | 106/1.22 |
| 3,977,884 | 8/1976 | Gulla et al. | 106/1.27 |
| 4,483,711 | 11/1984 | Harbulak et al. | 106/1.22 |
| 4,486,233 | 12/1984 | Josso et al. | 106/1.22 |

FOREIGN PATENT DOCUMENTS

| | | | |
|---|---|---|---|
| 2749151 | of 1979 | Fed. Rep. of Germany | D06Q 104 |
| 1253224 | of 1971 | United Kingdom | C23C 3/02 |

OTHER PUBLICATIONS

Electroless Nickel Plating, Wolfgang Riedel; ASM International, Metals Park, Ohio, USA; Finishing Pub., Ltd., Stevenage Hertfordshire, England, pp. title pp. 13, 17-25, 41-44, 50-51, 64-70, 101-104, 245-251, 1991.

*Primary Examiner*—Helene Klemanski

*Attorney, Agent, or Firm*—Thomas E. Kelley; Mark F. Wachter

[57] ABSTRACT

Phosphorus-containing, crystalline, nickel-coated fabric, wherein said nickel contains 1 to 6 weight percent phosphorus, has crystallites greater than 3 nanometers and has a surface resistivity of less than 1 ohm/square is deposited onto a substrate a surface which is catalytic to electroless deposition of nickel by immersing the substrate into an electroless nickel plating solution consisting essentially of nickel salt, one or more organic acids, hypophosphite reducing agent, thiourea and ammonia and essentially no heavy metal, wherein the concentration of said thiourea is less than 1 ppm, maintained at a pH of 6.5 to 8.5 and a temperature less than 60° C. Preferred plating solutions comprise essentially no lead or cadmium and have a molar ratio of nickel to hypophosphite in said solution is 0.4 to 0.55. Preferred organic acids are selected from the group consisting of lactic acid, acetic acid, propionic acid, pyruvic acid, aspartic acid and glycolic acid.

5 Claims, 1 Drawing Sheet

ELECTROLESS NICKEL PLATING SOLUTION

Disclosed herein are phosphorus-containing, crystalline, electroless nickel coatings and solutions and methods for providing such coatings.

BACKGROUND OF THE INVENTION

Nickel is commonly electrolessly deposited from solutions containing hypophosphite reducing agent, a chelant and stabilizers, including organic acids and thiourea. Such solutions typically are operated at an acidic pH of about 4.5 to 5.5 and a moderately high temperature of about 90° C. Unfortunately when such solutions are used to apply nickel coatings onto high surface area substrates such as fabrics, the baths become unstable and crash. When such baths are stabilized by reducing the operating temperature to about 55° C., the plating rate and the quality of the nickel plated onto fabrics is typically diminished. For instance, the nickel often exhibits an amorphous quality, e.g. with crystallite size less than 2 nanometers (20 Angstroms), and a surface resistivity of about 10 ohms/square or more. Moreover, commercial electroless nickel solutions often contain a heavy metal such as lead or cadmium to complex with degradation products of thiourea, such as sulfur. The presence of such heavy metal often makes it environmentally difficult to treat or dispose of depleted plating baths.

An object of this invention is to provide electrolessly-deposited nickel-coated fabrics having low surface resistivity. Another object of this invention is to provide electroless nickel plating solutions essentially devoid of heavy metals, such as lead or cadmium. Yet another object of this invention is to provide methods of electrolessly plating a layer of highly conductive, phosphorus-containing, crystalline nickel.

SUMMARY OF THE INVENTION

This invention provides phosphorus-containing, crystalline, nickel-coated fabric, where the nickel layer contains 1 to 6 weight percent phosphorus, has crystallites greater than 3 nanometers and has a surface resistivity of less than 1 ohm/square. Such fabrics can be provided by use of another aspect of this invention, i.e. electroless nickel plating solutions consisting essentially of nickel salt, one or more organic acids, hypophosphite reducing agent, thiourea, ammonia and essentially no heavy metal, wherein the concentration of said thiourea is less than 1 ppm. Accordingly another aspect of this invention provides methods of electrolessly plating a layer of phosphorus-containing, crystalline nickel by immersing a catalytic substrate in such a plating solution at a temperature below 60° C.

DETAILED DESCRIPTION OF PREFERRED EMBODIMENTS

Figure 1:
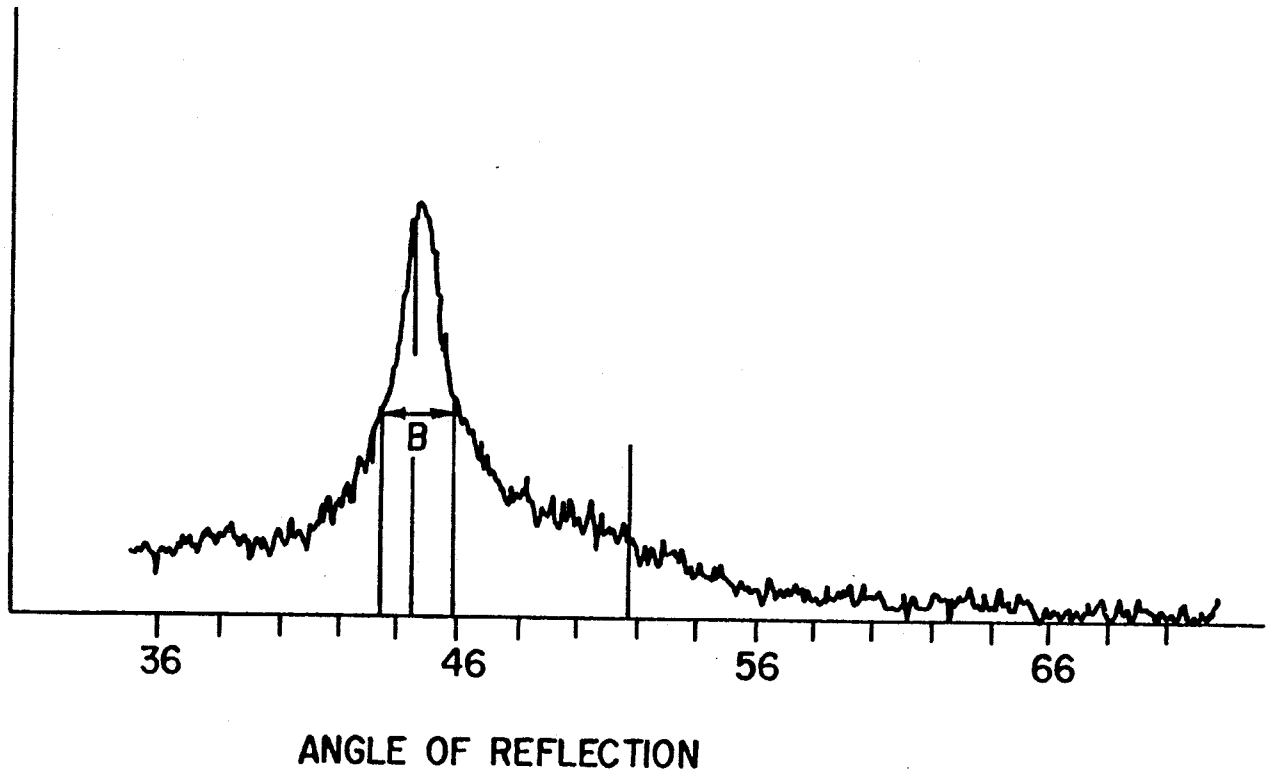
FIG. 1 is an X-ray diffraction pattern of a phosphorus-containing, crystalline, electrolessly-deposited nickel layer.

As used herein the term "crystallites" means particles of metal having size determined by X-ray diffraction analysis. In this regard reference is made to the X-ray diffraction pattern of FIG. 1, where the dimension B is the half shoulder width of the nickel peak. The size of the crystallites, t, is calculated from the expression $t=(0.9\ \lambda)/B\ \cos\theta$, where $\lambda$ is the wavelength of the X-ray beam and $\theta$ is the angle of reflection at the center of the nickel peak.

As used herein "surface resistivity" of metal layers, e.g. on fabric, is determined in accordance with ASTM F 390-78, a Standard Test Method for sheet resistance of thin metallic films with a collinear four-probe array. Surface resistivities are reported in units of "ohms/square", "ohms", "ohms/square centimeter" and the like, all of which are considered to be equivalent by practitioners in the field.

Unless stated otherwise, in the description and claims of this invention "percents" are intended to be by weight and temperatures are in degrees Celsius.

Textile articles, e.g. woven or non-woven fabric, sliver or tow, are characterized as having a high surface area, for example because textile articles comprise multilayers of filaments, interior surface area can be far larger than macroscopic surface area. The high catalytic density provided by textile articles as compared to "flat" surface articles often overloads the activity of electroless plating baths, causing them to spontaneously reduce metal throughout the bath volume, an undesireable process known as "crashing". Commercially available electroless nickel plating baths can be operated with textile materials if the bath activity is reduced, e.g. by operating at lower than design temperature, e.g. 60° C. instead of 90° C., or by adding high levels of stabilizers, e.g. thiourea, which retards the deposition rate. The use of such modified nickel baths provides nickel-coated textiles having less than desirable properties, e.g. surface resistivity of about 10 ohms/square or more.

This invention provides a novel electroless nickel plating bath that can provide nickel-coated textile articles, e.g. woven or non-woven fabric, comprising a layer of highly conductive, electrolessly-deposited phosphorus-containing, crystalline nickel. In one aspect of the invention the substrate fabric comprises a conductive material such as carbon or graphite fiber. In another aspect of the invention the substrate fabric comprises a non-conductive material such as glass fiber or thermoplastic polymer fiber, e.g. nylon, polyester or acrylic fiber. Such nickel contains 1 to 6 weight percent phosphorus, preferably 2 to 3.5 percent phosphorus. Many electrolessly deposited nickel layers of the prior art are somewhat amorphous being characterized as having crystallites of small size, e.g. less than 2 nanometers. It is believed that such amorphous nature contributes to less than desirable electrical properties, e.g. surface resistivities of 10 ohms/square or higher. The nickel layers provided by this invention are of a more crystalline nature being characterized as having crystallites of larger size, e.g. greater than 3 nanometers, preferably greater than 4 nanometers. Such nickel has an unexpectedly low surface resistivity, i.e. less than 1 ohm/square, preferably less than 0.5 ohms/square.

Another aspect of this invention is electroless nickel plating solutions consisting essentially of nickel salt, one or more organic acids, hypophosphite reducing agent, thiourea and ammonia and essentially no heavy metal, wherein the concentration of said thiourea is less than 1 ppm. Many prior art nickel baths contain thiourea, a stabilizer, at higher levels, e.g. at least 1 to 2 ppm. The prior art baths typically contain a heavy metal such as lead or cadmium to complex with sulfide ions which are believed to be a degradation product of thiourea. The plating solutions of this invention comprising essentially no lead or cadmium surprisingly provide highly conductive layers of nickel which are not adversely affected by sulfides. In preferred solutions according to this invention the concentration of thiourea as a stabilizer is 0.1 to 0.3 ppm.

The electroless nickel plating solutions of this invention will typically comprise up to 10 g/l nickel, preferably 2 to 8 g/l nickel. These solutions require a reducing agent, preferably hypophosphite ion which can be provided as the sodium salt. Hypophosphite ion is present in the molar ratio of nickel to hypophosphite of 0.4 to 0.55.

The electroless nickel plating solutions of this invention contain one or more organic acids selected from the group consisting of lactic acid, acetic acid, propionic acid, pyruvic acid, aspartic acid and glycolic acid. Since the plating solution requires a nickel complexing agent, at least one of organic acids should be lactic acid, pyruvic acid, aspartic acid or glycolic acid which can complex with nickel. The amount of chelant can be varied to optimize plating performance. For instance, in a solution containing 4 g/l nickel complexed with lactic acid, useful chelant concentrations range from 0.2 to 0.8M, preferably 0.4M. Acetic acid and/or propionic acid can be used as stabilizers, e.g. to retard the action of the reducing agent on deposition of nickel. Typical organic acid stabilizer concentrations range from about 1 to 30 ml/l.

Unlike prior art solutions which operate best at an acidic pH of 4.5 to 5, it has been discovered that the plating solutions of this invention operate best at a near neutral or slightly alkaline pH, e.g. from 6.5 to 8.5, preferably 7 to 8. The desired pH of the plating solutions can be achieved by addition of ammonia.

This invention also provides methods of electrolessly plating a layer of phosphorus-containing, crystalline nickel. Such methods require a substrate having a surface which is catalytic to electroless deposition of nickel, e.g. containing palladium or other metal more noble than nickel. As indicated above, in the methods of this invention such catalytic substrate is immersed in a solution consisting essentially of nickel salt, one or more organic acids, hypophosphite reducing agent, thiourea and ammonia and essentially no heavy metal, where the concentration of said thiourea is less than 1 ppm and the temperature is below 60° C. Catalytic substrates can be provided by a variety of methods known in the art. A preferred method of providing catalytic textile substrates is found in U.S. Pat. No. 5,082,734, incorporated herein by reference.

The following examples are intended to illustrate embodiments of the preparation and use of various aspects of this invention with no intention of limiting the scope of the invention. On the contrary, it is intended that the breadth of the invention illustrated by reference to the materials and compositions used in the following examples extends to the full scope of the invention as claimed.

EXAMPLE 1

A non-woven fabric of nylon filaments was catalyzed by immersion in an aqueous solution of 0.4% butadiene acrylonitrile copolymer emulsion and 0.1% palladium, e.g. as illustrated in U.S. Pat. No. 5,082,734. Excess solution was allowed to drip from the fabric which was dried in air at 35° C. and made catalytic by heating in air at 180° C. Samples of such catalytic fabric were immersed in each of the following commercial electroless plating solutions operated at 90° C.:

(a) Solution 429M from Enthone-OMI, Inc.
(b) Solution 7054 from MacDermid, Inc. and
(c) Solution 6100 from Atochem N. A. In each case the plating bath crashed shortly after immersion of the catalytic fabric indicating instability due to the high catalytic density of the textile substrate.

EXAMPLE 2

The procedure of Example 1 was essentially repeated except that the bath temperature was reduced to 55° C. to lower the activity. The Enthone 429M bath provided a semi-bright nickel-coated fabric having crystalline particle size of 1.8 nanometers and surface resistivity of 13 ohms/square. The MacDermid 7054 bath provided a semi-bright nickel-coated fabric having crystalline particle size of 1.7 nanometers and surface resistivity of 7 ohms/square. The Atochem 6100 bath provided a dull nickel-coated fabric having crystalline particle size of 3.4 nanometers and surface resistivity of 20 ohms/square.

EXAMPLE 3

The procedure of Example 1 was essentially repeated except the electroless nickel plating solution was according to this invention and prepared as an aqueous solution of 4 g/l nickel (added as nickel sulfate hexahydrate), 30 ml/l of 85% lactic acid, 15 ml/l acetic acid, 3 ml/l propionic acid, 15 g/l sodium hypophosphite monohydrate, 0.25 ppm thiourea and 35 ml/l of 14.3M ammonium hydroxide. The solution had a pH of 7.2, a molar ratio of nickel to hypophosphite of 0.486 and a temperature of 55° C. The fabric was provided with a very bright nickel coating having crystalline particle size of 4.4 nanometers, surface resistivity of 0.3 ohms/square and phosphorus content of 3.2 weight percent.

COMPARATIVE EXAMPLE 4

The procedure of Example 3 was essentially repeated except the electroless nickel plating solution was provided with a molar ratio of nickel to hypophosphite of 0.42. The fabric was provided with a bright nickel coating having crystalline particle size of 2.5 nanometers, surface resistivity of 0.6 ohms/square and phosphorus content of 5.3 weight percent.

COMPARATIVE EXAMPLE 5

The procedure of Example 3 was essentially repeated except the electroless nickel plating solution was provided with a molar ratio of nickel to hypophosphite of 0.36. The fabric was provided with a semi-bright nickel coating having crystalline particle size of 1.7 nanometers, surface resistivity of 0.7 ohms/square and phosphorus content of 9.8 weight percent.

While specific embodiments have been described herein, it should be apparent to those skilled in the art that various modifications thereof can be made without departing from the true spirit and scope of the invention. Accordingly, it is intended that the following claims cover all such modifications within the full inventive concept.

What is claimed is:

1. An electroless nickel plating solution consisting essentially of nickel salt, one or more organic acids selected from the group consisting of lactic acid, acetic acid, propionic acid, pyruvic acid, aspartic acid and glycolic acid, hypophosphite reducing agent, thiourea and ammonia and essentially no heavy metal, wherein the concentration of thiourea is less than 1 ppm, wherein the pH of said solution is alkaline.

2. A solution according to claim 1 comprising essentially no lead or cadmium.

3. A solution according to claim 2 wherein the concentration of thiourea of 0.1 to 0.3 ppm.

4. A solution according to claim 1 wherein the molar ratio of nickel to hypophosphite is 0.4 to 0.55.

5. An electroless nickel plating solution consisting essentially of: nickel salt and hypophosphite reducing agent wherein the molar ratio of nickel to hypophosphite is 0.4 to 0.55; one or more organic acids selected from the group consisting of lactic acid, acetic acid, propionic acid, pyruvic acid, aspartic acid and glycolic acid; stabilizers comprising from 0.1 to 0.3 ppm thiourea and essentially no cadmium or lead; and sufficient ammonia to provide said solution with an alkaline pH.

* * * * *